US005366430A

United States Patent [19]

Yao

[11] Patent Number: 5,366,430

[45] Date of Patent: Nov. 22, 1994

[54] TWIST DISC

[76] Inventor: Ching-Hui Yao, P.O. Box 10780, Taipei, Taiwan, Prov. of China

[21] Appl. No.: 195,646

[22] Filed: Feb. 14, 1994

[51] Int. Cl.[5] ..... A63B 22/14

[52] U.S. Cl. ..... 482/147; 482/79

[58] Field of Search ..... 482/146, 147, 79

[56] References Cited

U.S. PATENT DOCUMENTS 3,063,714 11/1962 Krauss ..... 482/147

3,806,116 4/1974 Malmberg et al. ..... 482/147

5,096,188 3/1992 Shen ..... 482/51

*Primary Examiner*—Stephen R. Crow

*Assistant Examiner*—Lynne A. Reichard

[57] ABSTRACT

An improved twist disc structure having a base disc with an axle in the center thereof for pivotally fitted thereon a movable disc, the upper surface of the base disc being provided with a plurality of undulating tracks. The movable disc has multiple through holes provided therein, and each through hole accommodates a lifting element. The base of these through holes are supported on the tracks. When the movable disc rotates on the base disc, the lifting elements move up and down in the corresponding through holes to massage the points on the soles of the user.

4 Claims, 2 Drawing Sheets

TWIST DISC

FIELD OF THE INVENTION

The present invention relates generally to an improved twist disc structure, and particularly to a twist disc having a massaging function.

BACKGROUND OF THE INVENTION

The twist disc is a device which helps train the user's waist and legs. Easy to use, it is quite popular.

The conventional twist disc structure is as shown in FIG. 1, comprising a base disc 1 and a movable disc 2. A vertical axle 11 is fixed in the center of the base disc 1 for pivotally inserted thereon the movable disc 2. Multiple support elements 3 are disposed between the base disc 1 and the movable disc 2 so that the base disc 1 and the movable disc 2 may perform relative motion. The upper surface of the movable disc is provided with a non-skid surface upon which the user stands. To use the twist disc in exercise, the user simply stands on the twist disc and twists his/her trunk, and the twist force is transmitted via the legs so that the movable disc 2 turns on the base disc 1, achieving the object of exercising the muscles of the waist and the legs.

However, the conventional twist disc does not have any other functions other than the one mentioned above. Therefore, it may be helpful to those who want to lose weight, but to most people, it is not very useful.

SUMMARY OF THE INVENTION

The primary object of the present invention is to provide a twist disc having a sole massaging function, wherein when the user stands on the disc and twists, the disc of the present invention not only trains the muscles of the waist and legs but also stimulates the points on the soles to improve the user's health.

The twist disc according to the present invention comprises a base disc having a plurality of undulating tracks thereon, and a movable disc being pivotaly fitted on an axle in the center of the base disc and supported by a plurality of support elements, the movable disc having a multiplicity of through holes therein for accommodating a multiplicity of lifting elements so that when the movable disc turns on the base disc, each lifting element moves up or down the corresponding through hole by means of a counter-force of the tracks on the base disc, wherein each lifting element projects from the moveable disc when it moves up its corresponding through hole, hence generating intermittent pressure on the user's soles to promote the user's health.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

The preferred embodiment of the twist disc of the present invention is as shown in FIGS. 2, 3, 4 and 5. The improved twist disc comprises a base disc 1 having a vertical axle 11 in the center thereof; a movable disc 2 pivotally fitted on the axle 11 of the base disc 1; and a plurality of support elements 3 arranged between the base disc 1 and the movable disc 2 for supporting the movable disc 2.

Figure 3:
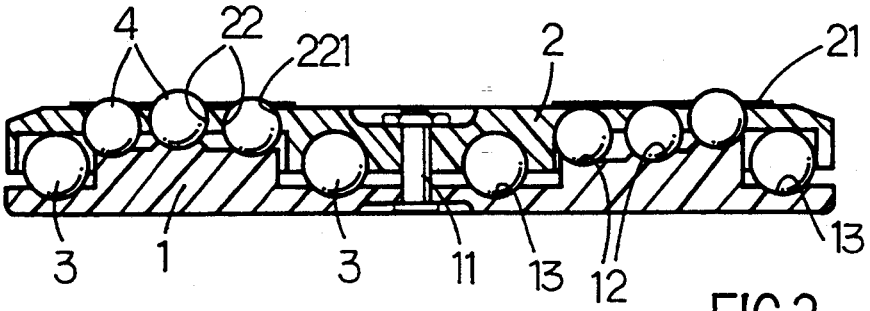
FIG. 3 is a sectional view taken along line A—A of FIG. 2.
Figure 1:
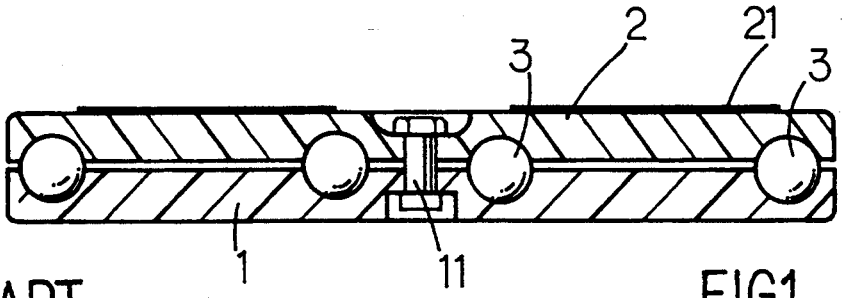
PRIOR ART FIG.1
FIG. 1 is a sectional view of the conventional twist disc.
Figure 4:
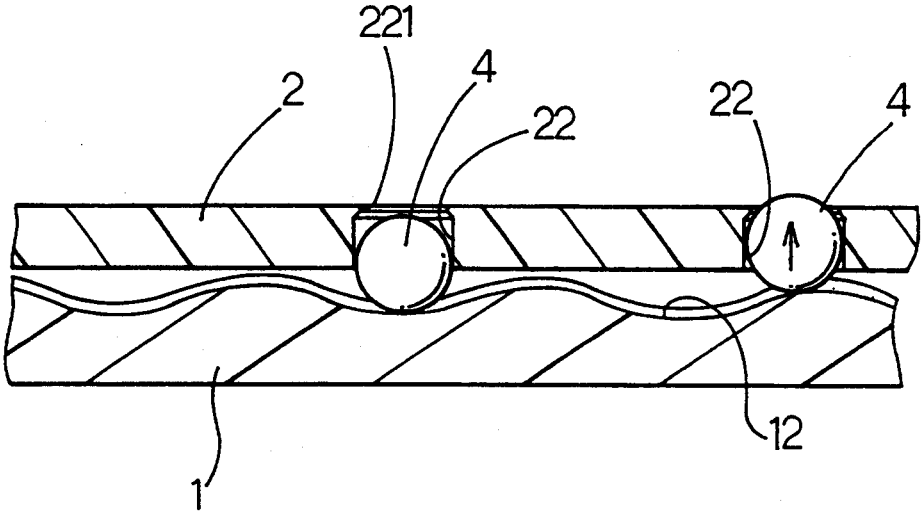
FIG. 4 is a sectional view taken along line B—B of FIG. 2.
Figure 5:
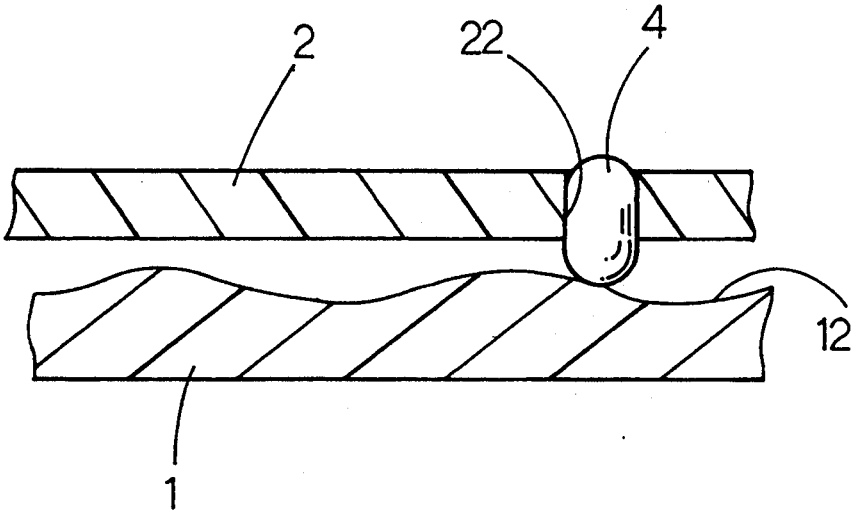
FIG. 5 is similar to FIG. 4, but showing another preferred embodiment.

The present invention is characterized in that the base disc has a plurality of undulating tracks 12 provided thereon; these tracks 12 are preferably concentric wavy structures as shown in FIGS. 4 and 5. A multiplicity of through holes 22 are provided in the movable disc 2 and in each through hole 22 is disposed a lifting element 4 which moves up and down in the through hole 22 by means of the counter-force of the tracks 12 on the base disc 1 when the movable disc 2 and the base disc 1 perform relative motion. As shown in FIGS. 3, 4 and 5, when each lifting element 4 moves up the corresponding through hole 22, a part thereof projects from the moveable disc 2 to intermittently stimulate the points on the soles of the user.

Figure 2:
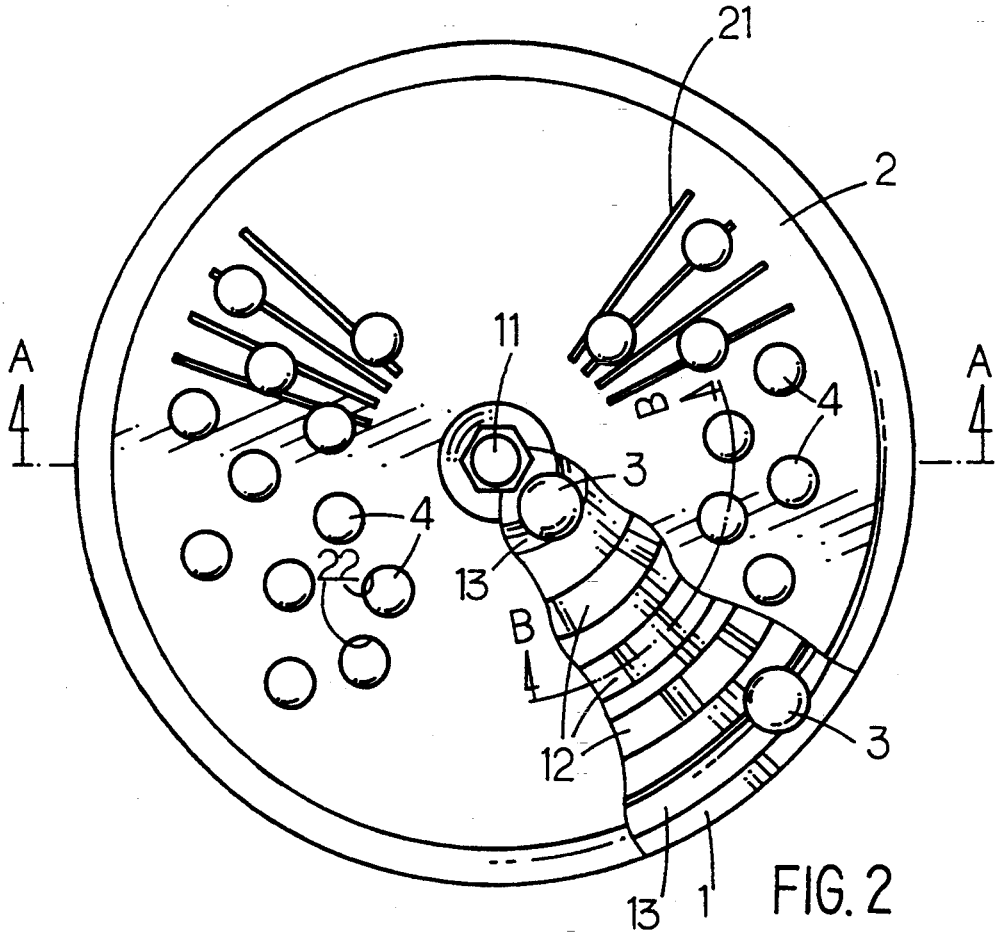
FIG. 2 is an top elevational view of a preferred embodiment of the present invention.

The movable disc 2 may also be provided with a non-skid surface 21 which, however, must not cover the through holes 22. The support elements 3 between the base disc 1 and the movable disc 2 are preferably steel balls as shown in FIG. 2, and which are preferably distributed in the vicinity of the axle 11 and the outer area of the movable disc 2. Each of the support elements 3 is accommodated in a circular slot 13 in the base disc 1.

The diameter of the upper edge 221 of each through hole 22 in the movable disc 2 is preferably slightly smaller than the diameter of each corresponding lifting element 4 so that the lifting element 4 may move up or down the through hole 22 without slipping out. These lifting elements 4 are preferably spherically bodies such as steel balls, although they are shown as rods in FIG. 5. If desired, they may be magnetic bodies, which not only stimulate intermittently the soles of the user when they move up the corresponding through holes to project from the movable disc to provide a sense of relaxation but also further promote the user's health in accordance with the principles of oriental medicine. The tracks 12 are preferably concentric undulating structures as mentioned above, but concentric grooves as shown in FIG. 2 are more preferred because such a configuration facilitates the manufacture of the twist disc of the present invention and the twist disc may not be damaged easily.

Although the present invention has been illustrated and described with reference to the preferred embodiments thereof, it should be understood that it is in no way limited to the details of such embodiments, but is capable of numerous modifications within the scope of the appended claims.

What is claimed is:

1. An improved twist disc for intermittently stimulating the soles of the user when the user stands on said twist disc and twists, said twist disc comprising:

a base disc having a vertical axle in the center thereof;

a movable disc pivotally fitted onto said axle on said base disc;

a plurality of support elements provided between said base disc and said movable disc for supporting said movable disc, wherein a plurality of undulating tracks are provided on said base disc, and a multiplicity of through holes are provided in said movable disc and a multiplicity of lifting elements are accommodated in the corresponding through holes for moving up and down therein by means of a counter-force of said tracks on said base disc when said movable disc and said base disc perform relative motion, said lifting elements projecting from said movable disc when moving up the corresponding through holes.

2. An improved twist disc as claimed in claim 1 wherein said tracks on said base disc are distributed concentrically with said axle as the center.

3. An improved twist disc as claimed in claim 1 wherein said lifting elements are spherical bodies.

4. An improved twist disc as claimed in claim 1 wherein said lifting elements are magnetic bodies.

* * * * *